US008655228B2

(12) United States Patent
Fukamachi

(10) Patent No.: US 8,655,228 B2
(45) Date of Patent: Feb. 18, 2014

(54) IMAGE FORMING APPARATUS

(75) Inventor: Asuna Fukamachi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 329 days.

(21) Appl. No.: 13/216,288

(22) Filed: Aug. 24, 2011

(65) Prior Publication Data

US 2012/0051814 A1 Mar. 1, 2012

(30) Foreign Application Priority Data

Aug. 27, 2010 (JP) ..... 2010-191251

(51) Int. Cl.
*G03G 15/22* (2006.01)

(52) U.S. Cl.
USPC ..... 399/127; 399/341; 399/223

(58) Field of Classification Search
USPC ..... 399/127, 341
See application file for complete search history.

(56) References Cited

U.S. PATENT DOCUMENTS

| | | | | |
|---|---|---|---|---|
| 6,535,712 | B2 * | 3/2003 | Richards | 399/341 |
| 7,260,354 | B2 * | 8/2007 | Ishida | 399/409 |
| 7,412,198 | B2 * | 8/2008 | Isemura et al. | 399/341 |
| 7,787,816 | B2 * | 8/2010 | Kladias et al. | 399/400 |
| 7,912,514 | B2 * | 3/2011 | Choi | 455/573 |
| 8,190,076 | B2 * | 5/2012 | Omata | 399/341 |
| 2009/0231604 | A1 * | 9/2009 | Miura | 358/1.9 |

FOREIGN PATENT DOCUMENTS

| | | | |
|---|---|---|---|
| JP | 08006375 | A * | 1/1996 |
| JP | 09200551 | A * | 7/1997 |
| JP | 2002318482 | A * | 10/2002 |
| JP | 2006251722 | A * | 9/2006 |
| JP | 2010049000 | A * | 3/2010 |

* cited by examiner

*Primary Examiner* — Clayton E LaBalle
*Assistant Examiner* — Leon W Rhodes, Jr.
(74) *Attorney, Agent, or Firm* — Fitzpatrick, Cella, Harper & Scinto

(57) ABSTRACT

An image forming apparatus includes detecting means for detecting a temperature of a recording material on which a non-transparent toner image is heat-fixed; transparent image forming means for effecting image formation by transparent toner on the basis of transparent image data; a heating device for heating the transparent toner image formed by the transparent image forming means; and correcting means for correcting an amount, per unit area, of the transparent toner which is deposited on the non-transparent toner image fixed on the recording material, by the transparent image forming means in accordance with a temperature detected by the detecting means.

7 Claims, 12 Drawing Sheets

| | | | | |
|---|---|---|---|---|
| 196 | 192 | 165 | 151 | 137 |
| 224 | 205 | 192 | 192 | 205 |
| 231 | 206 | 181 | 196 | 216 |
| 244 | 218 | 208 | 195 | 207 |
| 264 | 246 | 211 | 218 | 213 |

COLOR IMAGE DATA [%]

AVERAGE IN WINDOW 204.6%

Fig. 11

IMAGE FORMING APPARATUS

FIELD OF THE INVENTION AND RELATED ART

The present invention relates to an image forming apparatus for forming an image of transparent toner on a recording material on which a non-transparent toner is fixed.

With use of a copying machine or a printer in a variety of fields, the need for high quality images increases.

As one of the qualities, there is a glossiness appearance. More particularly, a print output includes high and low glossinesses on one surface, or the whole surface of the print has uniformly high, intermediate or low glossiness. Depending on usage of the print, a subdued nature or a high glossiness photograph-like nature is desired.

Japanese Laid-open Patent Application 2006-251722 discloses a structure for outputting a print using transparent toner.

Japanese Laid-open Patent Application 2010-049000 discloses an apparatus including a device capable outputting a full-color image and a device provided downstream of the device to form an image with transparent toner. As compared with Japanese Laid-open Patent Application 2006-251722, the structure disclosed in Japanese Laid-open Patent Application 2010-049000 is preferable in that by connecting the device provided with the transparent image forming station to the existing image forming apparatus, the glossy expression becomes possible.

However, it has been found that with the structure in which a plurality of devices are connected with each other as in Japanese Laid-open Patent Application 2010-049000, there arises a difference in the glossinesses between the first output image and the output image produced several tens later.

The inventor's investigation has revealed that this is because a temperature of the recording material having the fixed non-transparent toner image is unstable.

SUMMARY OF THE INVENTION

It is a principal object of the present invention to provide a device in which variation in a gloss difference between a clear portion where transparent toner is overlaid on a non-transparent toner image and a color portion only of a non-transparent toner image is suppressed against a temperature change of the recording material.

According to an aspect of the present invention, there is provided an image forming apparatus comprising detecting means for detecting a temperature of a recording material on which a non-transparent toner image is heat-fixed; transparent image forming means for effecting image formation by transparent toner on the basis of transparent image data; a heating device for heating the transparent toner image formed by said transparent image forming means; and correcting means for correcting an amount, per unit area, of the transparent toner which is deposited on the non-transparent toner image fixed on the recording material, by said transparent image forming means in accordance with a temperature detected by said detecting means.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 11 shows a toner amount for each pixel in a window.

DESCRIPTION OF THE PREFERRED EMBODIMENTS

<First Embodiment>

Figure 1:
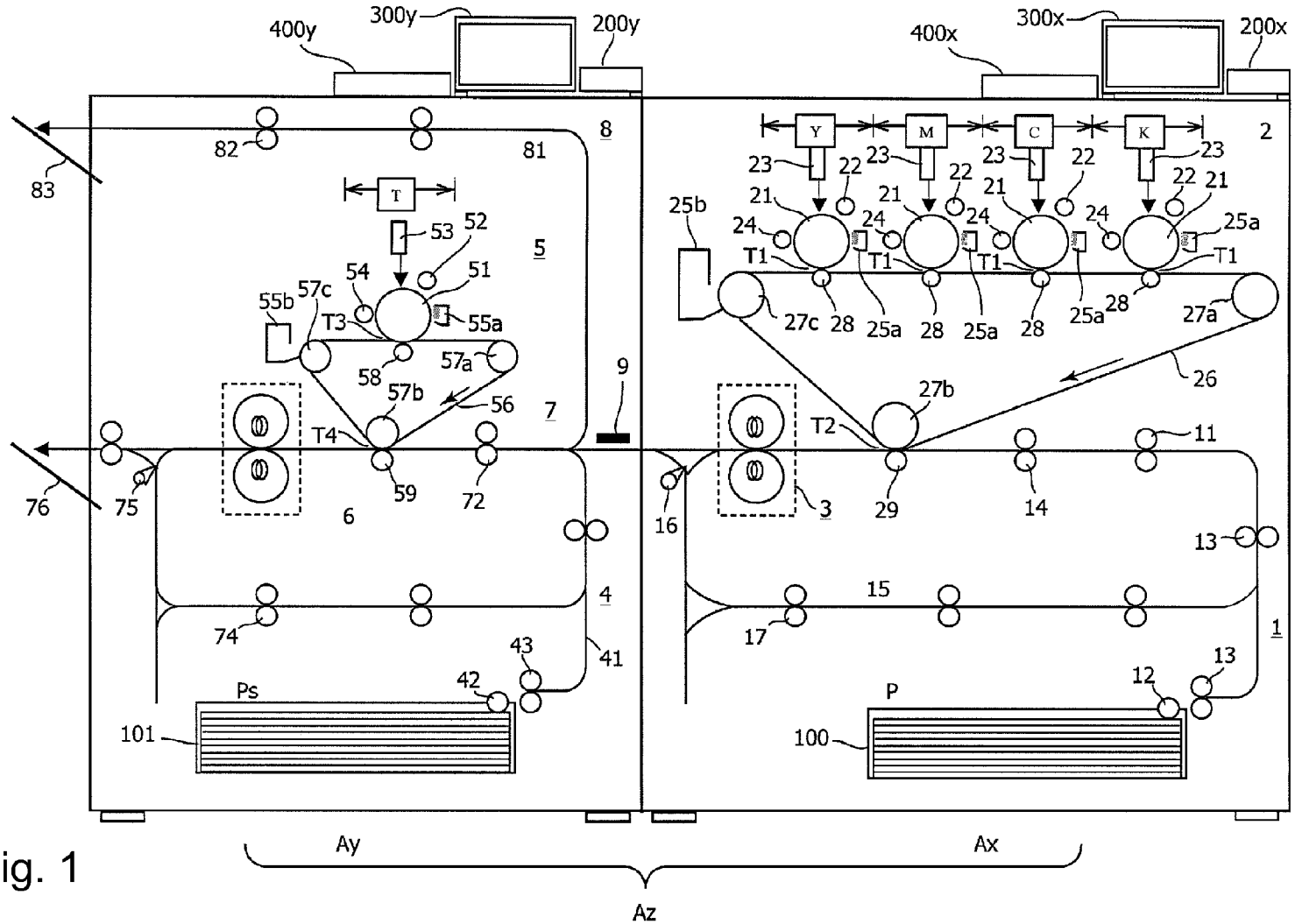
FIG. 1 is a schematic sectional view of an image forming apparatus according to a first embodiment of the present invention.

Referring to FIG. 1 to FIG. 9, a first embodiment of the present invention will be described. Referring first to FIG. 1, the general structure of the image forming apparatus according to the first embodiment will be described. The image forming apparatus Az of this embodiment comprises an image forming apparatus Ax for forming color images and an image forming apparatus Ay for forming transparent images, which are connected with each other.

[Image Forming Apparatus]

The image forming apparatus Ax includes inside thereof a first feeding cassette 100, a first feeding portion 1 an image forming station (non-transparent image forming station), and a first fixing portion 3. The image forming apparatus Ay includes inside thereof a second feeding cassette 101 as an accommodating portion, a second feeding portion (supply passage), an image forming station) transparent image forming station) 5 as transparent image forming means, a second fixing portion 6 and a third feeding portion 7. Here, the second feeding portion 4 supplies the recording material Ps accommodated in the second feeding cassette 101 to the transparent image forming station 5 without passing through the non-transparent image forming station 2. The image forming apparatus Ay is provided with a temperature sensor 9 as temperature detecting means for detecting a temperature of the recording material P.

It will suffice if the temperature sensor 9 is disposed adjacent to a feeding path which is after the first fixing portion 3 of the image forming apparatus Az and before the second fixing portion 6, or it may be disposed in the image forming apparatus Ax. In this embodiment, it is disposed on the third feeding portion 7 before the transparent image forming station 5 of the image forming apparatus Ay.

The non-transparent image forming station 2 forms a non-transparent toner image using non-transparent toner on the recording material P fed by the first feeding portion 1. The first fixing portion 3 fixes by heat the non-transparent toner image on the recording material P fed from the non-transparent image forming station 2 by the first feeding portion 1. The transparent image forming station 5 forms a transparent toner image using transparent toner so as to be overlaid on the non-transparent toner image fixed on the recording material by the first fixing portion 3. The second fixing portion 6 fixes by heat the transparent toner image on the recording material P fed from the transparent image forming station 5 by the third feeding portion 7. The third feeding portion 7 feeds the recording material P carrying the image formed in the non-transparent image forming station 2 as described hereinbefore, and discharges the recording material P having the image formed by the non-transparent image forming station 2 and the transparent image forming station 5 to an outside of the image forming apparatus Az.

<Non-Transparent Image Forming Station>

The structures of the non-transparent image forming station 2 will be described in more detail. The non-transparent image forming station 2 is provided along a feeding path 11 which will be described hereinafter, the feeding path 11 being a part of the first feeding portion 1. In the non-transparent image forming station 2, there are juxtaposed substantially horizontally four image forming stations Y, M, C and K for forming a color toner image using four kinds of toner including Y (yellow), M (magenta), C (cyan) and K (black) toner. The structure of the image forming stations Y, M, C and K are substantially common except for the colors of the developers.

Each image forming station Y, M, C and K includes a drum like electrophotographic photosensitive member (photosensitive drum) as an image bearing member.

Around the outer surface of the photosensitive drum 21, there are provided a charging roller 22 as charging means, exposing unit 23 as image exposure means, a developing device 24 as developing means, a drum cleaner 25*a* as cleaning means and another process means.

The developing device 24 includes a toner accommodating container (unshown) accommodating predetermined color toner, and a developing roller (unshown) as developer carrying member for carrying toner in the toner accommodating container.

In addition, there is provided an intermediary transfer belt 26 as an intermediary transfer member contacting the surface of the photosensitive drum 21. The intermediary transfer belt 26 is extended around a follower roller 27*a*, a secondary transfer opposing roller 27*b*, and a driving roller 27*c*. The intermediary transfer belt 26 travels (rotates) in the direction indicated by the arrow by the rotation of the driving roller 27*c*. A primary transfer roller 28 is provided opposed to the surface of the photosensitive drum 21 with the intermediary transfer belt 26 interposed therebetween, by which a primary transfer nip T1 is formed between the surface of the photosensitive drum 21 and the outer surface of the intermediary transfer belt 26. A secondary transfer roller 29 is provided opposed to the secondary transfer opposing roller 27*b* with the intermediary transfer belt 26 interposed therebetween, by which a secondary transfer nip T2 is formed between the surface of the intermediary transfer belt 26 and the secondary transfer roller 29. The follower roller 27*a* applies a predetermined tension to the intermediary transfer belt 26. Downstream of the secondary transfer nip T2 with respect to the rotational moving direction of the intermediary transfer belt 26, there is provided a belt cleaner 25*b* as a cleaning means.

The photosensitive drum 21, the charging roller 22, the developing roller, the primary transfer roller 28, the driving roller 27*c* and the secondary transfer roller 29 are operatively connected through a gear train (unshown). A driven gear of the gear train is rotationally driven by a driving gear (not shown) provided on an output shaft of the color image formation motor (not shown). By this, the photosensitive drum 21, the charging roller 22, the developing roller, the primary transfer roller 28, the intermediary transfer belt 26 and the secondary transfer roller 29 are operated substantially at a process speed of 130 mm/sec. An exposure scanning speed of the exposing unit 23 is set corresponding to the operation at the process speed of the photosensitive drum 21.

<First Feeding Portion>

The first feeding portion 1 disposed below the non-transparent image forming station 2 is provided with the feeding path 11 which guides the recording material P from the first feeding cassette 100 through the secondary transfer nip T2 of the non-transparent image forming station 2 and through the fixing nip of the first fixing portion 3 to the third feeding portion 7 of the image forming apparatus Ay. Along the feeding path 11 from the first feeding cassette 100, there are provided a pick-up roller 12, a plurality of pairs of feeding rollers 13, registration rollers 14 and so on. The pick-up roller 12 functions to separate the recording material P one by one from the first feeding cassette 100 accommodating a stack of recording materials P and to feed it to the feeding rollers 13. And, the feeding rollers 13 feed the recording material P toward the registration rollers 14. The registration rollers 14 control the delivery timing of the recording material P so that the timing at which the unfixed non-transparent toner image on the surface of the intermediary transfer belt 26 enters the secondary transfer nip T2 matches the timing at which the recording material P enters the secondary transfer nip T2.

The first feeding portion 1 includes a reverse feeding path 15 for reversing the recording material P discharged to the feeding path 11 from the first fixing portion 3 to flip its face orientation and for guiding the recording material P to the feeding rollers 13. Along the reverse feeding path 15, a plurality of pairs of feeding rollers 17 are provided. Downstream of the first fixing portion 3 with respect to the feeding direction of the recording material in the first feeding portion 1, a deflector 16 for reversing the recording material is provided. The reversing deflector 16 enters, when the image is formed on one surface thereof, the reverse feeding path 15 to open the feeding path 11 to guide the recording material to the third feeding portion 7 from the feeding path 11. On the other hand, when images are to be formed on both sides of the recording material P, the reversing deflector member 16 enters the feeding path 11 and opens the reverse feeding path 15 to guide the recording material P from the feeding path 11 to the reverse feeding path 15.

The pick-up roller 12, the pairs of the feeding rollers and the registration rollers 14 are connected by gear trains (not shown). One of the gears in the gear trains is a driven gear which is rotationally driven by the driving gear (not shown) provided on the output shaft of the feeding motor (not shown). By doing so, the pick-up roller 12, the pairs 13, 17 of the feeding rollers and the registration rollers 14 are rotated substantially at a process speed 130 mm/sec, for example. As the feeding means for the recording material, there are a sheet feeding cassette detachably mounted to the casing, and a manual insertion recording material tray, and as an optional device, a sheet feeding deck is provided, and the kinds of the sheets accommodated can be set.

<Transparent Image Forming Station>

The structures of the transparent image forming station 5 will be described. The transparent image forming station 5 is provided along a feeding path 71 of the third feeding portion 7. The transparent image forming station 5 comprises image forming process equipment similar to the non-transparent image forming station 2. The transparent toner (clear toner) (T) as the developer used in the transparent image forming station 5 comprises the same components as the color toner except that it does not contain coloring pigment. In this embodiment, a transparent image forming station T using the transparent toner as another developer is employed as a transparent image forming station 5.

The transparent image forming station T includes drum like electrophotographic photosensitive member (photosensitive drum) 51 as the image bearing member. Around the outer surface of the photosensitive drum 51, there are provided a charging roller 52 as charging means, exposing unit 53 as image exposure means, a developing device 54 as developing means, a drum cleaner 55*a* as cleaning means and another process means. The developing device 54 includes a toner accommodating container (unshown) accommodating predetermined color toner, and a developing roller (unshown) as developer carrying member for carrying toner in the toner accommodating container.

In addition, there is provided an intermediary transfer belt 56 as an intermediary transfer member contacting the surface of the photosensitive drum 51. The intermediary transfer belt 56 is extended around a follower roller 57*a*, a secondary transfer opposing roller 57*b*, a driving roller 57*c*. The intermediary transfer belt 56 travels (rotates) in the direction indicated by the arrow by the rotation of the driving roller 57*c*. A primary transfer roller 58 is provided opposed to the surface of the photosensitive drum 51 with the intermediary transfer belt 56 interposed therebetween, by which a primary transfer nip T3 is formed between the surface of the photosensitive drum 51 and the outer surface of the intermediary transfer belt 56. A secondary transfer roller 59 is provided opposed to the secondary transfer opposing roller 57*b* with the intermediary transfer belt 56 interposed therebetween. By this, a secondary transfer nip T4 is formed between the surface of the intermediary transfer belt 56 and the secondary transfer roller 59. The follower roller 57*a* functioning also as a tension roller applies a predetermined tension to the intermediary transfer belt 56. Downstream of the secondary transfer nip T4 with respect to the rotational moving direction of the intermediary transfer belt 56, there is provided a belt cleaner 55*b* as cleaning means.

The photosensitive drum 51, the charging roller 52, the developing roller, the primary transfer roller 58, the driving roller 57*c* and the secondary transfer roller 59 are operatively connected through a gear train (unshown). A driven gear of the gear train is rotationally driven by a driving gear (not shown) provided on an output shaft of the special-color image formation motor (not shown). By this, the photosensitive drum 51, the charging roller 52, the developing roller, the primary transfer roller 58, the intermediary transfer belt 56 and the secondary transfer roller 59 are operated substantially at a process speed of 130 mm/sec. An exposure scanning speed of the exposing unit 53 is set corresponding to the operation at the process speed of the photosensitive drum 51.

<Second Feeding Portion>

The image forming apparatus Ay includes a second feeding portion 4 which is provided below a third feeding portion 7 which will be described hereinafter. The second feeding portion 4 includes a feeding path 41 for guiding another recording material Ps from the second feeding cassette 101 to the feeding path 71 between the registration roller 72 and the deflector member 75, using a part of a reverse feeding path 73 of the third feeding portion 7. Along the feeding path 41 from the second feeding cassette 101, there are provided a pick-up roller 42, a pair of feeding rollers 43 and so on. The pick-up roller 42 functions to separate the recording material Ps one by one from the second feeding cassette 101 accommodating a stack of recording materials Ps and to feed it to the feeding rollers 43. The pair of feeding rollers 43 feed the recording material P toward the feeding path 71 through a part of the reverse feeding path 73.

The pick-up roller 42 and the pair of the feeding roller 43 are connected with each other through a gear train (not shown). One of driven gears of the gear train is rotationally driven by a driving gear (not shown) provided on an output shaft of a second feeding motor (not shown). By this, the pick-up roller 42 and the feeding rollers 43 are rotated substantially at the process speed 130 mm/sec, for example.

<Third Feeding Portion>

The third feeding portion 7 includes the feeding path 71 for guiding the recording material P fed from the first fixing portion 3 through the feeding path 11 of the first feeding portion 1 to the transparent image forming station 5 and the second fixing portion 6, and for guiding it to a discharging tray 76 provided in feeding path 71.

The feeding path 71 merges to the feeding path 11 and the feeding path 41 of the second feeding portion 4 in the direction of the recording material feeding direction of the first feeding portion 1.

The third feeding portion 7 includes a reverse feeding path 73 for reversing the recording material P discharged to the feeding path 71 from the second fixing portion 6 its face orientation and for guiding the recording material P to the registration roller 72. Along the reverse feeding path 73, a plurality of pairs of feeding rollers 74 are provided. Downstream of the second fixing portion 6 with respect to feeding direction of the recording material in the third feeding portion 7, a deflector 75 for reversing the recording material is provided. When the image is formed on one side of the recording material P, the reversing deflector member 75 enters into the reverse feeding path 73 to guide the recording material P from the feeding path 71 to the discharging tray 76. When the image is formed on both sides of the recording material P, on the other hand, the reversing deflector member 75 enters into the feeding path 71 to open the reverse feeding path 73 to guide the recording material P from the feeding path 71 to the reverse feeding path 73.

The registration roller 72 and the feeding roller pairs 74 are connected with each other through a gear train (not shown). One of the gears in the gear trains is a driven gear which is rotationally driven by the driving gear (not shown) provided on the output shaft of a special-color feeding motor (not shown). By doing so, the registration roller 72, the pairs 74 of the feeding rollers are rotated substantially at a process speed 130 mm/sec, for example.

<Fourth Feeding Portion>

The image forming apparatus Az of this embodiment further comprises fourth feeding portion 8 in addition to the above-described feeding portions. The fourth feeding portion 8 includes a feeding path 81 which is provided in the image forming apparatus Ay for forming the transparent image and which guides the recording material P fed from the first fixing portion 3 through the feeding path 11 of the first feeding portion 1 to the second discharging tray 83 provided the device Ay. The feeding path 81 merges with the feeding path 11 in the feeding direction of the recording material of the first feeding portion 1 and merges with the feeding path 71 in the feeding direction of the recording material of the third feeding portion 7. Along the feeding path 81, a plurality of the pairs of feeding rollers are provided.

The feeding roller pairs 82 are connected through a gear train (not shown). One gear of the gear train is a driven gear which is rotationally driven by a driving gear (not shown) provided on the output shaft of the special-color feeding motor (not shown). By this, the feeding roller pairs 82 rotate substantially at the process speed 130 mm/sec.

<Temperature Sensor>

A temperature sensor 9 is provided on the feeding portion 7 disposed at the front part of the transparent image forming station 5. The temperature sensor 9 may be provided at any place along the feeding path from the first fixing portion 3 to the second fixing portion 6. For example, it may be disposed on the feeding portion before a fixing process portion adjacent the second fixing portion 6. The temperature sensor 9 detects a temperature of the recording material P on which the color image has been heat-fixed by the first fixing portion 3. Preferably, it detects the temperature of the recording material P a predetermined time after the first fixing portion 3. By doing so, it is known how much the temperature of the recording material P raised by the first fixing portion 3 decreases, so that the temperature of the recording material P when the image of the transparent toner is fixed in the second fixing portion 6 can be predicted. Using the predicted temperature, the toner amount correction control which will be described hereinafter can be more properly effected. Such temperature sensors may be provided along the feeding path.

Figure 3:
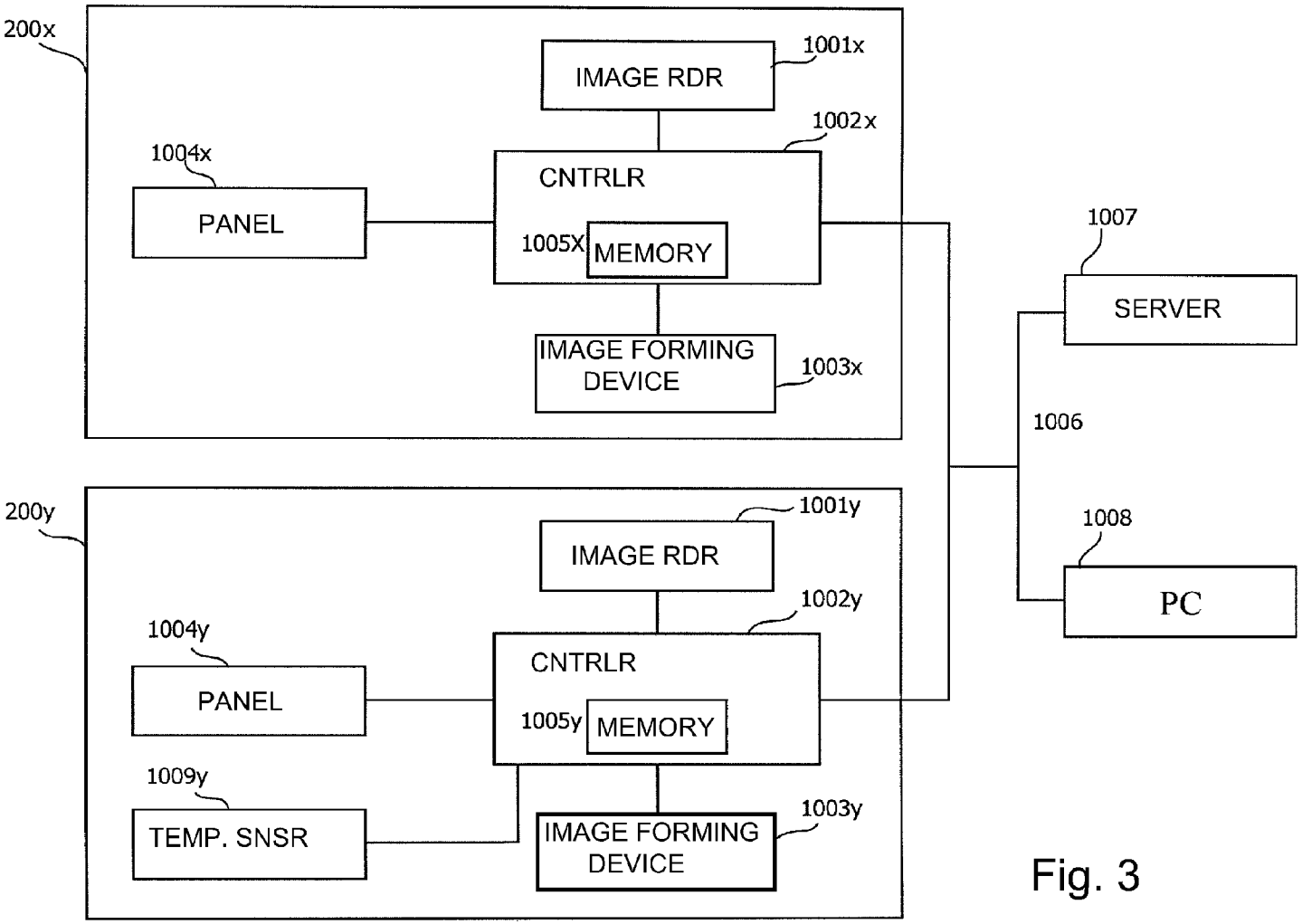
FIG. 3 is a block diagram of a controller used in the first embodiment.

The temperature sensor 9 is disposed at a substantially central portion of the recording material P with respect to the widthwise direction at a predetermined position along the feeding portion 7. When the recording material P having passed through the fixing portion 3 passes the feeding portion 7, it approaches or contacts the temperature sensor 9, and the temperature thereof is detected. The temperature sensor 9 includes a temperature detecting element. The type of temperature sensor is not particularly limited, and in this example, the temperature detecting element is a thermistor which detects the surface temperature of the surface (printed surface in the case of the one surface print) of the recording material P. When the temperature of the surface of the recording material P is detected, there is a possibility that the recording material is not yet fixed immediately after passing through the fixing nip, and the thermal capacity of the thermistor itself can be neglected, and therefore, the thermistor is a non-contact type. However, it is a possible alternative that the thermistor is disposed so as to detect a back side temperature of the recording material P. In such a case, the thermistor may be of a contact type. In any case, the temperature Ts detected by the temperature sensor 9 is temporarily stored in a memory (storing device) 1005Y of a controller 1002Y which will be described hereinafter (FIG. 3).

<Fixing Portion>

Figure 2:
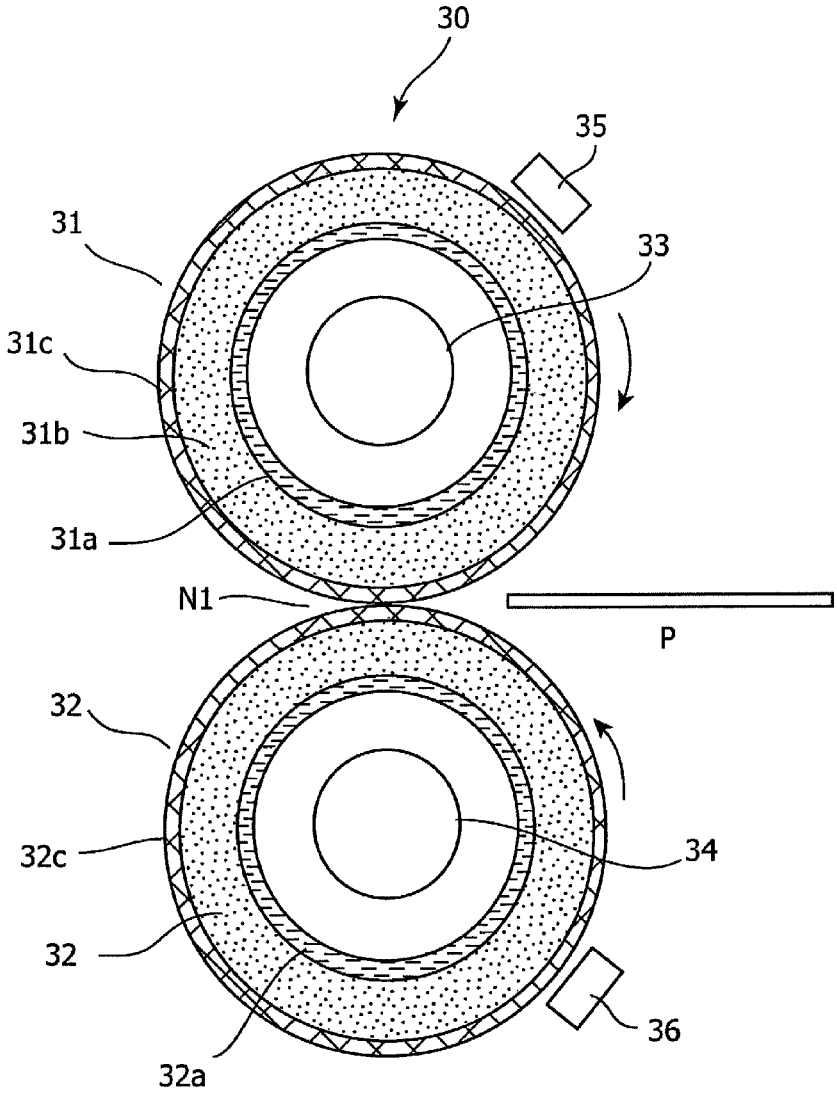
FIG. 2 is a schematic sectional view of a fixing device.

Referring to FIG. 2, the structures of the first fixing portion 3 and the second fixing portion 6 will be described. The first fixing portion 3 is disposed downstream of the secondary transfer nip T2 of the non-transparent image forming station 2 with respect to the feeding direction of the recording material in the first feeding portion 1. The second fixing portion 6 is disposed downstream of the secondary transfer nip T4 of the transparent image forming station 5 with respect to the feeding direction of the recording material in the third feeding portion 7.

The fixing device 30 which is the first fixing portion 3 or the second fixing portion 6 includes a fixing roller 31 as a fixing rotatable member and a pressing roller 32 as a pressing rotatable member for forming a fixing nip N1, the pressing roller 32 being contacted to the outer surface of the fixing roller 31. A pressure in the fixing nip N1 between the fixing roller 31 and the pressing roller 32 is approx. 490 N (50 kgf) in total pressure, for example.

The fixing roller 31 has a laminated structure comprising a hollow core metal 31*a* of metal such as aluminum or iron (Fe), a rubber layer 31*b* (elastic layer) on an outer surface of the hollow core metal 31*a*, and a fluorinated resin material layer 31*c* as a toner parting layer on the outer surface of the rubber layer 31*b*. Inside the hollow core metal 31*a*, a halogen heater 33 as a heating source is provided. Similarly to the fixing roller 31, the pressing roller 32 has a laminated structure comprising a hollow core metal 32*a*, a rubber layer 32*b* as an elastic layer on the outer surface of the hollow core metal 32*a*, and a fluorinated resin material layer 32*c* as a toner parting layer on the outer surface of the rubber layer 32*b*.

Inside the hollow core metal 32*a*, a halogen heater 34 as a heating source is provided. The heating source for the fixing roller 31 and the pressing roller 32 may be of an IH type using electromagnetic induction heating, for example.

Adjacent to each fixing roller 31 and pressing roller 32, a thermistor 35, 36 is provided as a temperature detecting means for detecting the temperature of the rollers. The actuation and deactuation of the electric power supply to the halogen heaters 33, 34 in the pressing roller 32 and the fixing roller 31 are controlled by control devices 200*x*, 200*y* which will be described hereinafter on the basis of output signals of the thermistors 35, 36. The target fixing temperatures of the fixing roller 31 is 180° C., and the target fixing temperature of the pressing roller 32 is 150° C. to maintain such fixing temperatures, the control devices 200*x*, 200*y* effect the temperature control.

The hollow core metal 31*a* of the fixing roller 31 is provided with a driven gear (not shown). The driven gear is rotationally driven by a driving gear (not shown) provided on the output shaft of the color image formation motor 2M. By doing so, the fixing roller 31 is rotated substantially at process speed 130 mm/sec. The rotational force of the fixing roller 31 is transmitted to the surface of the pressing roller 32 through the fixing nip, by which the pressing roller 32 is rotated by the fixing roller 31.

In this embodiment, the first fixing portion 3 comprises a pair of the fixing roller 31 and the pressing roller 32, but one of the fixing roller 31 and the pressing roller 32 may be replaced with an endless belt.

<Toner>

The description will be made as to the toner used in this embodiment. The color toner comprises a binder of polyester resin material, and it is produced by a pulverization method. Other manufacturing methods for the toner include a suspension polymerization method, an interface polymerization method, a dispersion polymerization method and a polymerization method. The manufacturing method and the component of the toner are not limiting. The clear toner comprises a binder of polyester resin material similarly to the color toner. As is different from the color toner, the clear toner does not comprise a color pigment.

The binder of the color toner is ordinarily polyester resin material having a glass transition point (Tg) of 45-60 degrees. The clear toner is not necessarily transparent. For example, it may be white before fixing. This is so, when, for example, the toner is pulverized into particle size of the toner is 5-10 microns. The surface of such pulverized clear toner particles reflects and scatters the light with the result that the light is neither transmitted nor absorbed. This is why it is white. The glass transition point (Tg) is not restrictive.

If the kind and/or molecular weight of the resin material of the clear toner is changed, the melting property thereof changes. Therefore, even when the same amount of the toner is used under the same fixing condition, different glossinesses are provided.

More particularly, the binder having a low glass transition point (Tg), that is, easily melting binder is used, the resulting glossiness tends to be high. On the contrary, the binder having a high glass transition point (Tg), that is, not easily melting binder is used, the resulting glossiness tends to be low.

In this embodiment, the color toner and the clear toner have substantially equivalent glass transition points. However, the glass transition point of the clear toner may be higher or lower than that of the color toner. Even if the same glass transition point toner is used, the glossiness tends to be higher by decreasing the fixing speed or by raising the fixing temperature, thus increasing the energy given to the toner.

Referring to FIGS. 1 and 3, the entire control of the image forming apparatus of this embodiment will be described. The image forming apparatus Az of this embodiment comprises the image forming apparatus Ax for forming the non-transparent toner image and the image forming apparatus Ay for forming the transparent toner image, as described hereinbefore. Each of the image forming apparatuses Ax, Ay are usable independently with the control devices 200*x*, 200*y* as the control means. The image reading devices 300*x*, 300*y* and operation panels 400*x* are provided, respectively. In the case that the image forming apparatus Ay is used together with the image forming apparatus Ax only, the control device 200*y*, the image reading devices 300*y* and the operation panel 400*y* of the image forming apparatus Ay may be omitted. In such a case, all the operations can be selected only on the operation panel 400*x* of the image forming apparatus Ax, the image reading device 300*x* is operable to read the transparent image data, and the overall control is effected by the control device 200*x*.

The image forming apparatus Az prints an image corresponding to the original image read by the image reading devices 300*x*, 300*y*. Here, the image reading device 300*x* reads non-transparent image data (color image data), and the image reading device 300*y* reads transparent image data (clear image data). This structure is not inevitable, and the image reading device 300*x* may read both of the color image data and the clear image data. The read color image data are stored in the memory 1005*x* in the signal processing portion (corresponding to the controller 1002*x* of FIG. 3) for each page of the original.

Thus, the memory 1005*x* stores the color image data. The color image data stored in the inside memory 1005*x* are electrically processed by the controller 1002*x* for each pixel, and the data are separated into magenta (M), cyan (C), yellow (Y) and black (K) components, which are sent to the image forming apparatus Ax.

Similarly, the clear image data are stored in the memory 1005Y in the signal processing portion (corresponding to the controller 1002*y* of FIG. 3), and the clear image data are separated or generated for each pixel, and are sent to the image forming apparatus Ay. The controllers 1002*x* and 1002*y* are connected with each other by a network such as LAN, and therefore, the color image data stored in the controller 1002*x* can be processed by the controller 1002*y*. It is a possible alternative that the controller 1002*y* may be controlled such that the clear image data stored in the controller 1002*x* are processed to operate the image forming apparatus Ay. The detail of the processing in the controllers 1002*x* and 1002*y* will be described in detail hereinafter, referring to FIG. 1. On the basis of the data thus delivered, the image forming apparatus Ax or the image forming apparatus Ay operates to produce the print. At this time, the image forming apparatus Ax operates for the color image data, and the image forming apparatus Ay operates for the clear image data.

The control devices 200*x*, 200*y* of this embodiment controls the image forming apparatuses Ax, Ay as described above, and has a structure shown in FIG. 3. More particularly, the control devices 200*x*, 200*y* include the image reading stations 1001*x*, 1001*y*, the controllers 1002*x*, 1002*y*, the operating portions 1004*x*, 1004*y* and the image forming stations 1003*x*, 1003*y*.

The image reading station 1001*x* reads the original in the image reading devices 300*x*, 300*y*. The controllers 1002*x*, 1002*y* effect the image processing of the image data read from the image reading stations 1001*x*, 1001*y* and store them in the memories 1005*x*, 1005*y*. The operating portions 1004*x*, 1004*y* set various printing conditions for the image data read by the image reading stations 1001*x* and 1001*y* in accordance with operations on the operation panels 400*x*, 400*y*. The image forming stations 1003*x*, 1003*y* effect visualized image formation on the recording material from the image data read from the memories 1005*x*, 1005*y* in accordance with the printing conditions set by the operating portions 1004*x*, 1004*y*.

The control device 200*y* comprises a temperature sensor portion 1009 for detecting the temperature of the recording material. The controller 1002*y* corrects the image data on the basis of the temperature detected by the temperature sensor portion 1009. The control devices 200*x* and 200*y* are connected with a server 1007 managing image data on a personal computer (PC) network 1008 instructing execution of the print to the image forming apparatus Az, or the like, through a network 1006 such as LAN or the like. Therefore, the image forming apparatus Ax, Ay is capable of image formation in accordance with the image data fed from the server 1007 or the PC1008, in addition to the image data read by the image reading devices 300*x*, 300*y*.

<Color Image Data and Clear Image Data>

In the following, the color image data (non-transparent image data) are image data on the basis of which a color toner image is formed on the recording material. The clear image data (transparent image data) are image data on the basis of which a clear toner image is formed on the recording material. The color image data will be described. The color image data includes four kinds of data, namely cyan image data, magenta image data, yellow image data and black image data. The cyan image data sets an amount of the cyan toner formed by the control device 200*x* on the recording material. Similarly, the magenta image data, the yellow image data and the black image data set the corresponding toner amounts.

The description will be made as to the cyan image data as an example. In this embodiment, the cyan image data includes the data (pixel values) for the pixels necessary for formation of the image corresponding to the resolution (dots per inch) of the image forming apparatus. The data corresponding to one pixel is 8 bit data. Using 8 bit data, 0-255 levels can be expressed. Therefore, using this, 256 levels of the tone gradation can be expressed. Thus, the cyan image data are a group of the data representing the density levels for all the pixels necessary for the formation of the cyan image. For simplicity of explanation, the maximum level of the 8-bit data, that is, 255 is 100% in the following.

The control device 200*x* changes amounts of toner of the color toner applied on the recording material in accordance with the inputted data (0-100%). In this embodiment, when the cyan image data in which the values corresponding to all pixels are inputted to the control device 200*x*, the non-transparent image forming station 2 forms cyan toner image of the weight of 0.5 mg per 1 $cm^2$, for example. In the following, the weight of the toner deposited on the area of 1 $cm^2$ is called deposited toner amount.

Similarly, the clear image data are a group of the data representing the density levels for all the pixels necessary for the formation of the clear image. The control device 200*y* changes the amount of the transparent toner formed on the recording material in accordance with the inputted data or corrected data provided by correction of the input data. In this embodiment, such image data is a value of the toner amount.

A maximum density and a maximum deposited amount are dependent on the property of the toner, the fixing condition of the fixing device, the kind of the recording material and the like. Therefore, the present invention is not limited to the specific examples of this embodiment. In the following, the pixel value is expressed as a total at a position of the image, for simplicity. For example, when the cyan image data is 20%, and magenta image data for the same position is 40%, the color image data is expressed as being 60%.

<In-Line Partial Clear Mode>

The in-line partial clear mode will be described. The in-line partial clear mode is a mode in which the clear image is formed partially on the color image. In this embodiment, in the in-line partial clear mode, the operation of the image forming apparatus is as follows fundamentally. A color toner image is formed by the non-transparent image forming station 2, and is fixed by the first fixing portion 3, and thereafter, a clear toner image of image data 100% is partially formed by the transparent image forming station 5.

In the in-line partial clear mode is the image forming mode which is one of characteristics of this embodiment, by which the clear toner is partially overlaid on the color toner image which comprises a large amount of toner so that an effective clear effect can be provided. Therefore, the in-line partial clear mode provides the clear-effect.

In the in-line partial clear mode, the clear toner image is not formed in a region An of the image region where the glossiness is to be higher. On the contrary, the clear toner image is formed in the region B other than region A. By doing so, in the region A (color portion) where the clear toner image is not formed, the glossiness is high, and the region B (clear portion), the glossiness is low. By the gloss difference between the region A and the region B, the glossiness of the image is partly adjusted.

The image forming apparatus according to this embodiment is operable in other modes other than the in-line partial clear mode. For example, it can be made operable in a color mode in which the non-transparent image forming station 2 forms a color toner image, and the first fixing portion 3 fixes it, and/or a clear-toner-only mode in which the transparent image forming station 5 forms a clear toner image, and the second fixing portion 6 fixes it. In the following the in-line partial clear mode will be described.

<Relation Between Temperature of Recording Material and Gloss Difference Ga−b>

Figure 4:
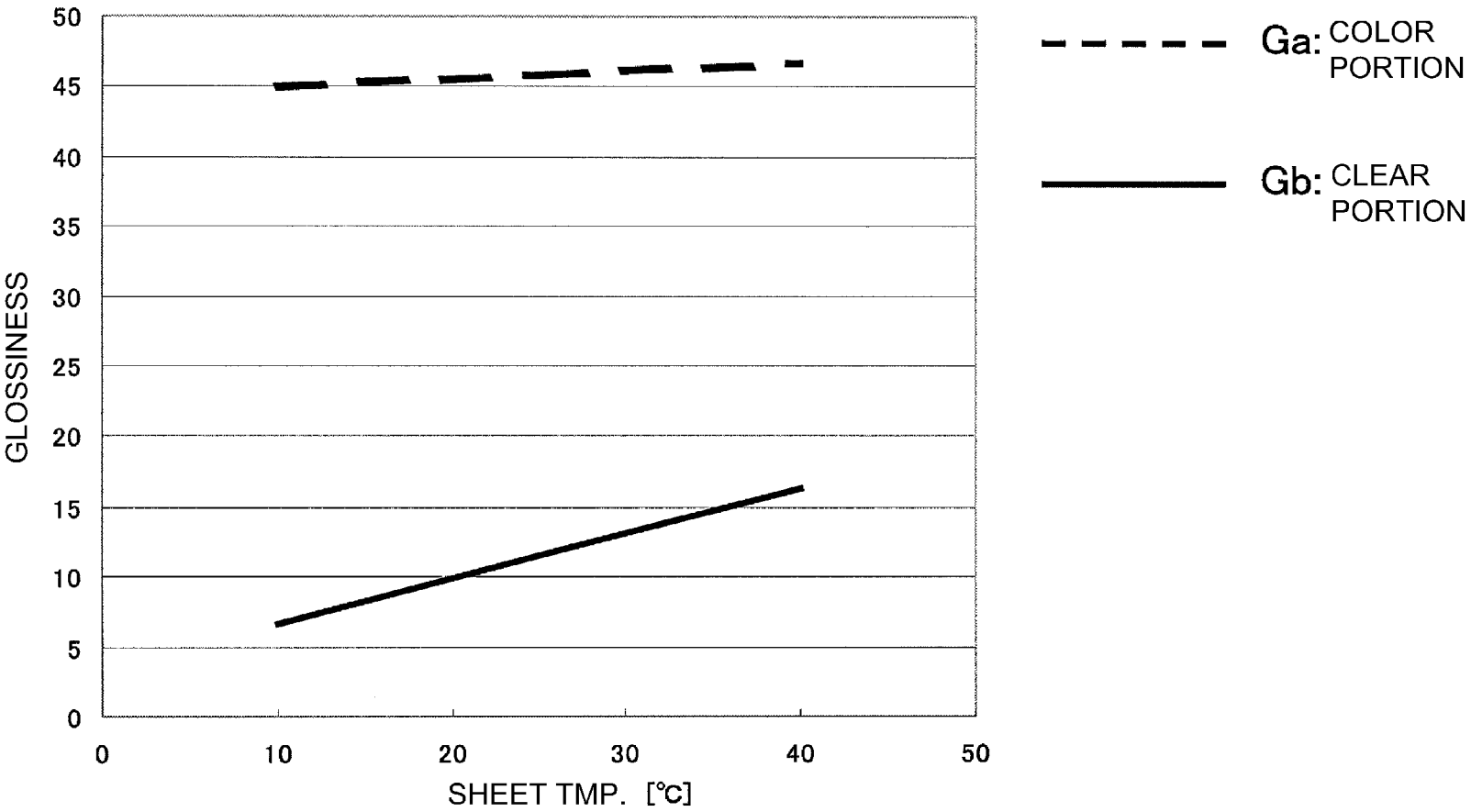
FIG. 4 shows a relation between a temperature of a recording material and a glossiness of a clear portion and a color portion.

First, the gloss difference between the clear portion and the color portion in connection with the temperature of the recording material will be described. FIG. 4 shows a result of investigation of the change in the glossiness when a clear toner image of clear image data 100% is formed partially on a color image of color image data 100% by the image forming apparatus of this embodiment. In this Figure, a broken line is a temperature change of the recording material of gloss Ga of the region A where only color toner is formed, and a solid line is a temperature change of the recording material of gloss Gb of the region B (clear portion) where the clear toner image is formed on the color image.

As shown in FIG. 4, the color portion (region A) passes through the first fixing portion 3 and the second fixing portion 6, and therefore, in this region, the amount of the thermal energy to the toner is large. For this reason, the gloss Ga of the color portion is relatively high, and is approx. 45 when the temperature of the recording material is as low as 10° C. On the other hand, in the clear portion (region B), because of the increase of the thermal capacity corresponding to the color toner and the decrease of the adhessiveness between the toner particles, the glossiness of the clear toner is low when an image thereof is formed on the color toner image than when it is formed directly on the recording material. Therefore, the gloss Gb of the clear portion is relatively low, and it is approx. 17 when the temperature of the recording material is as high as 40° C.

As a result of measurements of Ga and Gb when the temperature of the recording material changes in the range of 10-40° C., the change of the glossiness relative to the temperature of the recording material is larger in Gb than in Ga. That is in the case of the color portion where the gloss is high because of high fixing property, the toner surface of is already fused sufficiently and therefore is smooth, and therefore, the influence of the temperature of the recording material is low. On the other hand, in the clear portion where the glossiness is low, the influence of the temperature of the recording material is high, because the change of the heat quantity applied thereto influence the smoothness of the surface of the toner.

The temperature of the recording material is an output of the temperature sensor 9. The recording material used is a gloss coated paper sheet of basis weight of 150 g/m$^2$ (the same in the following unless described otherwise). The glossiness was measured using a handy type glossiness meter (PG-1M) available from Nippon Denshoku Kabushiki Kaisha, and it was a 60 degree glossiness value under JISZ8741, specular surface glossiness measuring method.

Figure 5:
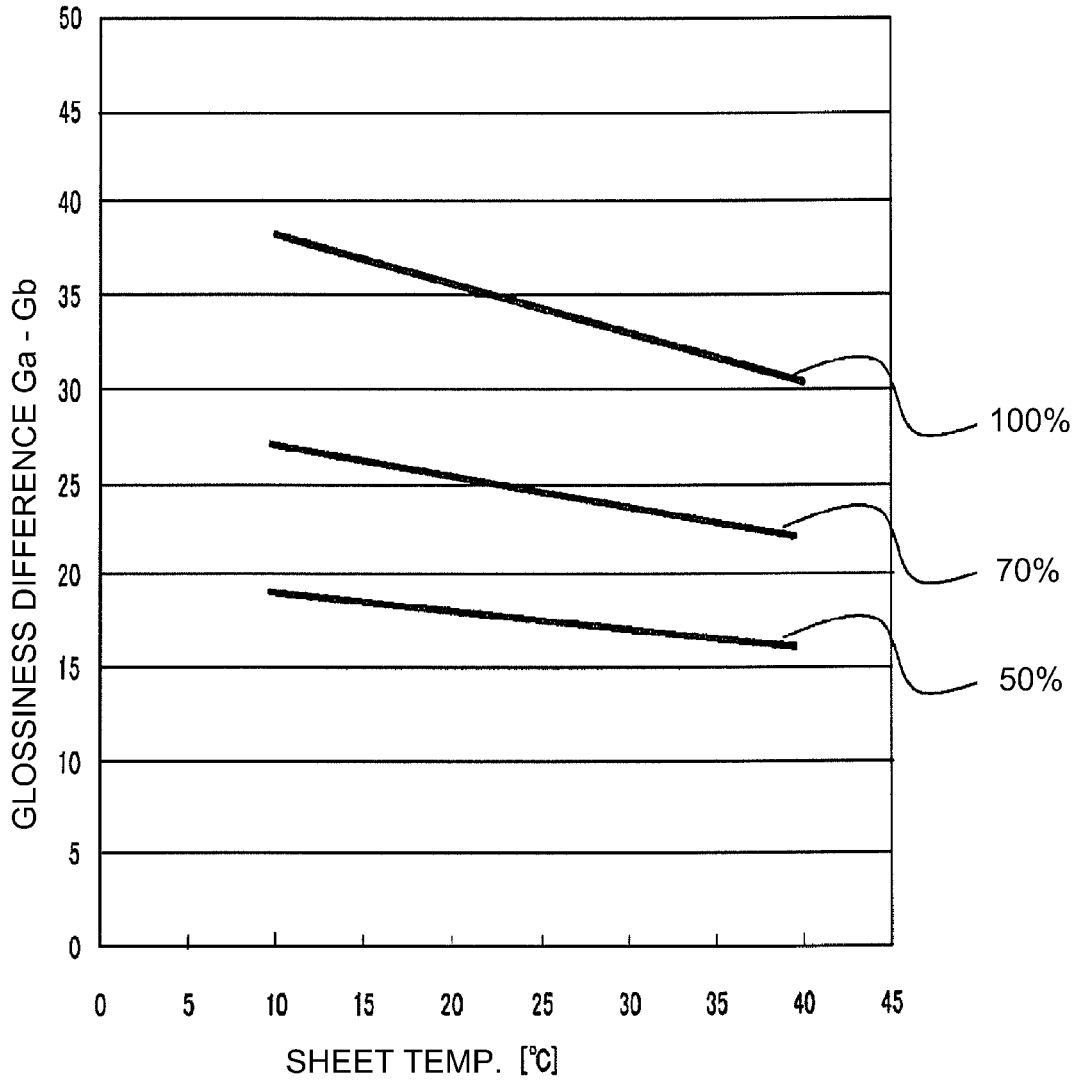
FIG. 5 shows a relation between a temperature of the recording material and a gloss difference in accordance with an amount (data amount) of color toner.

FIG. 5 is a graph showing a relation between the temperature of the recording material and the gloss difference Ga−Gb (Ga−b) between the color portion and the clear portion, when the color image data is 100%, 70% and 50%. As shown in FIG. 5, when the color image data is 100%, the gloss difference Ga−b increases by approx. 8 by decrease of 30° C. of the recording material temperature, and the glossiness of the clear portion looks low relative to the color portion. It is understood that the gloss difference changes depending on the temperature of the recording material. The recording material temperature variation of approx. 30° C. is probable when the temperature of the feeding path in the main assembly is low as in the case immediately after the main switch is turned on, or when the apparatus is kept inoperative for a relatively long term.

On the output print, the clear-effect will be recognized as a gloss difference Ga−b between the clear portion and the color portion. Generally speaking, when the variation in the gloss difference, $\delta Ga-b=\delta Gb-\delta Ga$ is 5 or more, the clear effect is visually recognized, and therefore, $\delta Ga-b=8$ is not preferable.

If the color image data are low, the color toner deposition amount on the recording material is small, and therefore, the recording material temperature dependency of the glossiness Gb of the clear portion is low, and the recording material temperature dependence of the gloss difference Ga−b is also low. In FIG. 5, when the color image data is 70%, $\delta Ga-b=\delta Gb-\delta Ga$ is 5, it is understood that when the color image data (which relates to the toner amount of the non-transparent toner image) is less than 70%, the variation of the gloss difference due to the temperature of the recording material can be neglected.

In order to suppress the variation Ga−b due to the recording material temperature variation, it will suffice if the variation δGb of the glossiness Gb of the clear portion due to the recording material temperature is minimized. As described hereinbefore, the variation of the gloss difference δGa−b is a problem when the color image data is not less than 70%. Therefore, when the color image data is less than 70%, a toner amount correction control for suppressing the variation of the gloss difference, which will be described hereinafter, is not effected. On the other hand, if the color image data which is a value relating to a toner amount of the non-transparent toner image obtained by the memory 1005*x* is not less than a predetermined value (70% in this embodiment), the toner amount correction control is effected.

In this embodiment, the clear image data amount, that is, the deposition amount of the clear toner is controlled in accordance with the color image data and the temperature of the recording material detected by the temperature sensor 9. By doing so, the gloss difference variation δGa−b is suppressed so as to provide appropriate gloss differences Ga−b.

<Relation Between Clear Image Data and Glossiness>

Figure 6:
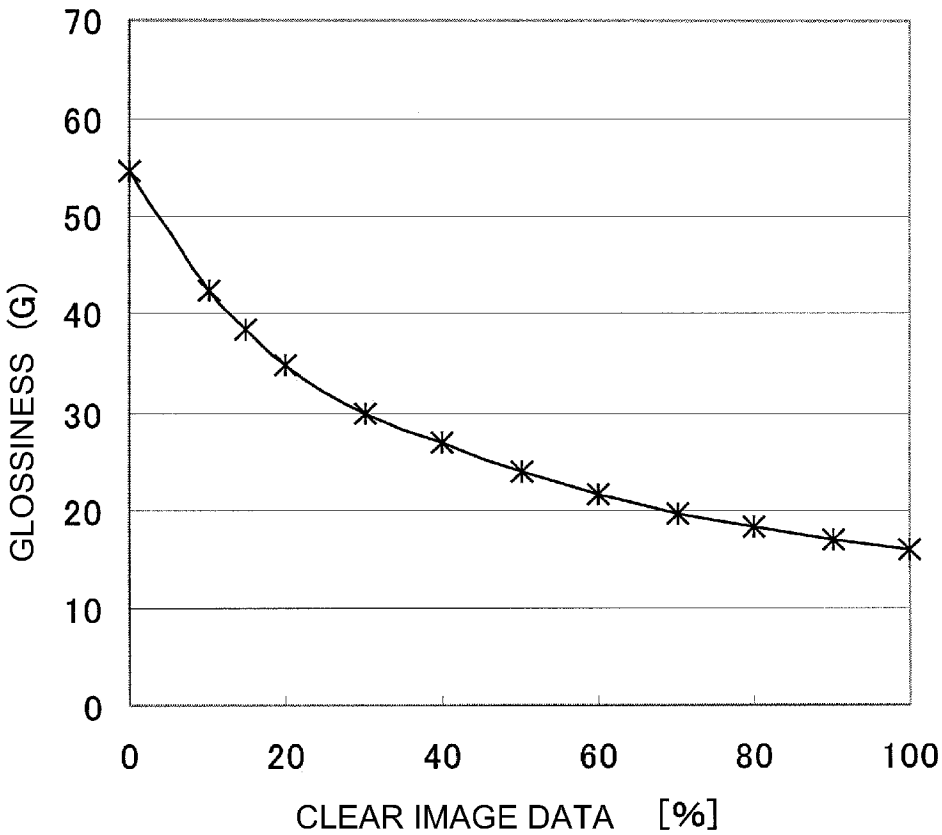
FIG. 6 shows a relation between a temperature of the recording material and a gloss difference.

The results of investigations about the relation between the clear image data and the gloss for the control of the toner amount of the clear toner will be described. FIG. 6 is a graph of the relation between the clear image data and the glossiness Gb of the clear portion on the color image. Here, the color image data is 100%. The recording material is a gloss coated paper sheet having a basis weight of 150 g/m$^2$.

From FIG. 6, it is understood that when the clear image data is large, the clear toner amount is larger, and correspondingly, the fixing property in the second fixing portion 6 decreases with the result of decrease of the gloss Gb. On the contrary, when the clear image data is small, the gloss Gb is high. Thus, it is understood that when the glossiness Gb of the clear portion lowers because of the decrease of the recording material temperature, the clear image data is decreased by which the glossiness Gb is raised.

For example, when the temperature of the recording material decreases by 30° C., the glossiness decrease of the color portion is δGa=2, and the glossiness decrease of the clear portion is δGb=10, and therefore, the gloss difference change is δGa−b=8. In this case, the clear image data is decreased so as to raise the glossiness Gb of the clear portion by approx. 8, by which gloss difference change is δGa−b=0. From FIG. 6, by decreasing the clear image data to 50% from 100%, the glossiness Gb rises by approx. 8, and therefore, the transparent image data stored in the memory 1005*y* (clear image data) is corrected from 100% to 50%. As a result of experiments of the inventors, it has been found that even when the temperature of the recording material changes, the (image data)−(glossiness) curve in FIG. 6 is the same within the range of not less than 20% of the clear image data.

In summary:

Based on the relation between the temperature variation of the recording material vs. glossiness variation δG, the glossiness variation δGa of the color portion and the glossiness variation δGb of the clear portion are predictable, from the variation of the temperature of the recording material. Next, based on the relation between the clear image data and the glossiness shown in FIG. 6, the clear image data for providing the desired glossiness difference Ga−b is predictable from the glossiness difference variation δGa−b=δGb−δGa. Such relations between the variation of the temperature of the recording material and the variation δG of the glossiness and between the clear image data and the glossiness are stored in the control device 200*y* or 200*x* beforehand as a correction table for each medium.

<Image Forming Operation>

The description will be made as to an image forming operation using the above-described color toner and clear toner. The operation modes of the image forming apparatus of this embodiment include a color mode in which the image formation is effected only by color toner, and a clear monochromatic mode in which the image formation is effected only by clear toner, but an in-line partial clear mode which is most characteristic in this embodiment will be described. Such image forming modes are stored in memory of the control devices 200*x* and 200*y* as image formation control sequences. A mode selection screen for selection of the image forming mode is in the display screen of the operation panel 400*x*. When the user selects an image forming mode, a mode selection screen for the printer drive is displayed on the operation panel 400*x*. Here, the in-line partial clear mode is selected as an example. In this embodiment, the selection and displaying operation are effected on the operation panel 400*x*, they may be effected on the operation panel 400*y*. Or, they may be effected on both of the operation panel 400*x* and the operation panel 400*y*.

Figure 7:
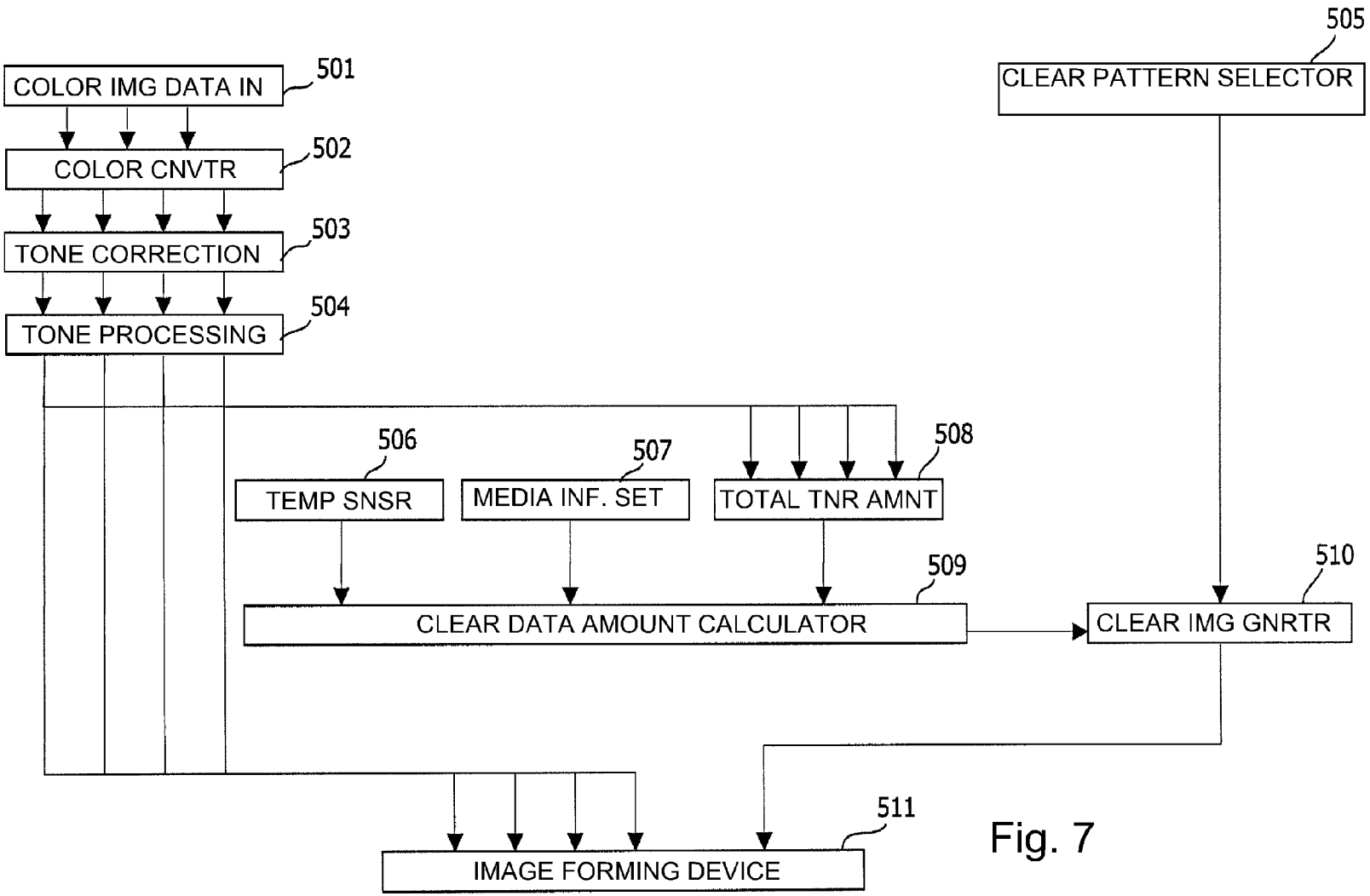
FIG. 7 is a block diagram of an image processing controller used in the first embodiment.

FIG. 7 is a block diagram of an image processing controller for effecting such an image formation, and shows details of the controllers 1002*x*, 1002*y* for effecting the image processing of the control devices 200*x* and 200*y*. Designated by 501, 502, 503, 504, 507, 508 are processings in the controller 1002*x*, and 505, 506, 509, 510 are processings in the controller 1002*y*. The belonging of the processings to the controller 1002*x* or to the 1002*y* are not limited to this example. For example, the processing portion 509 is a calculation portion for the amount of the clear data, and may be included in the controller 1002*x*.

The controllers 1002*x*, 1002*y* are supplied with a data file transferred from an external device such as a PC1008, color image data read by the image reading devices 300*x*, and the clear image data read by the image reading device 300*y*. A color image data input portion 501 once stores pixel data in the memory the image read by the image reading devices 300*x* for each page. A color converting portion 502 converts an image signal of R, G, B in a color space of the image reading device 300*x* to C, M, Y and K in a color space for the printing output, for each pixel. The generated C, M, Y and K are subjected to a tone gradation correction (so-called gamma correction) by the tone gradation correcting portion 503 so that proper tone gradation property is provided, a half-tone processing portion 504 effects a half-tone processing such as dither process.

The clear image pattern designation portion 505 is for designating an output pattern of the clear toner on the basis of the transparent image data inputted from the user interface of the operation panel 400*y* of the image forming apparatus Ay or an external device 1008 or the like. The information designated by the clear image pattern designation portion 505 is sent to the clear image generation portion 510.

The recording material temperature detecting portion 506 detects the temperature of the recording material detected by the temperature sensor 9. The information of the temperature of the recording material detected by the recording material temperature detecting portion 506 is sent to a clear data amount calculation portion 509.

A media information designating portion 507 is for designating a kind of the media on which image is to be formed, by the user interface of the operation panel 400*x* or an external device 1008. The information designated by the media information designating portion 507 is sent to the clear data amount calculation portion 509.

A total toner amount calculation portion 508 is an obtaining means that obtains values relating to the total toner amount of C, M, Y and K toners other than the clear toner component, that is, obtains the color image data. The total toner amount is a total amount of the signals of four colors C, M, Y and K, and is obtained for each pixel. Theoretically, the color image information is 400% of the image data at the maximum. However, in the actual image formation, the control device 200*x* carries out UCR or GCR process to make the maximum value per one pixel of the color image data is 180-240%. The information of the color image data calculated by the total toner amount calculation portion 508 is sent to the clear data amount calculation portion 509.

The UCR stands for Under Color Removal. More particularly, when a color original is separated into four colors, a gray component is produced in the area where C, M and Y components are overlaid, and it is replaced with black component. A gray component of a predetermined density level is replaced with the black component, by which the total toner amount can be reduced. The GCR stands for Gray Component Replacement. More particularly, the color of the position where ratios of C, M and Y are the same in the color separation image is black or gray. Such a part may be replaced by K, and then the dot ratio can be lowered, so that the total dot area ratio is lowered, and therefore, the total toner amount can be reduced.

A clear data amount calculation portion 509 calculates a clear image data correction value X, in accordance with the temperature of the recording material detected from the recording material temperature detecting portion 506, the media information designated by the media information designating portion 507, and the total toner amount calculated by the total toner amount calculation portion 508. That is, the amount of the clear toner to be deposited on the clear portion (the part of the color toner image on which the clear toner is to be deposited) is corrected, in accordance with the value (color image data) relating to the toner amount obtained by the total toner amount calculation portion 508 (obtaining means), and the temperature of the recording material detected by the temperature sensor 9. In this embodiment, such a correction control is called toner amount correction control. In the toner amount correction control of the this embodiment, a toner amount of the actually formed clear toner image is made smaller than the clear toner amount based on the clear image data in the clear portion. The clear toner amount based on the clear image data in the clear portion is a clear toner amount based on the clear image pattern designated by the clear image pattern designation portion 505. In other words, it is the toner amount without the correction (100%, for example). For this reason, the clear image data (clear image data correction value X) on which the image formation is carried out actually is smaller than the clear image data without the correction.

The information of the clear image data correction value X calculated by the clear data amount calculation portion 509 in such a manner is sent to the clear image generation portion 510. The clear image generation portion 510 generates the image to be outputted by the clear toner, and the information of the clear image pattern designated by the clear image pattern designation portion 505 and the clear image data correction value X calculated by the clear data amount calculation portion 509.

In this embodiment, when the color image data is not less than 70%, the correction of the clear image data is carried out. The correction of the clear image data is effected by controlling the printing area percentage of the clear toner layer, and more particularly, by changing a duty ratio (ratio of the exposure time) in the PWM (Pulse Width Modulation) control. In another example, the amount of the clear toner may be corrected by controlling the laser power, the charging bias voltage, the developing bias voltage, the transfer bias or the like.

The clear image data provided by the clear image generation portion 510 are sent to the image forming station 511 together with the four-color (C, M, Y and K) image signals provided by the half-tone processing portion 504. The full-color image of C, M Y and K and the clear toner image are combined, and are printed on the recording material to provide a final output image.

Figure 8:
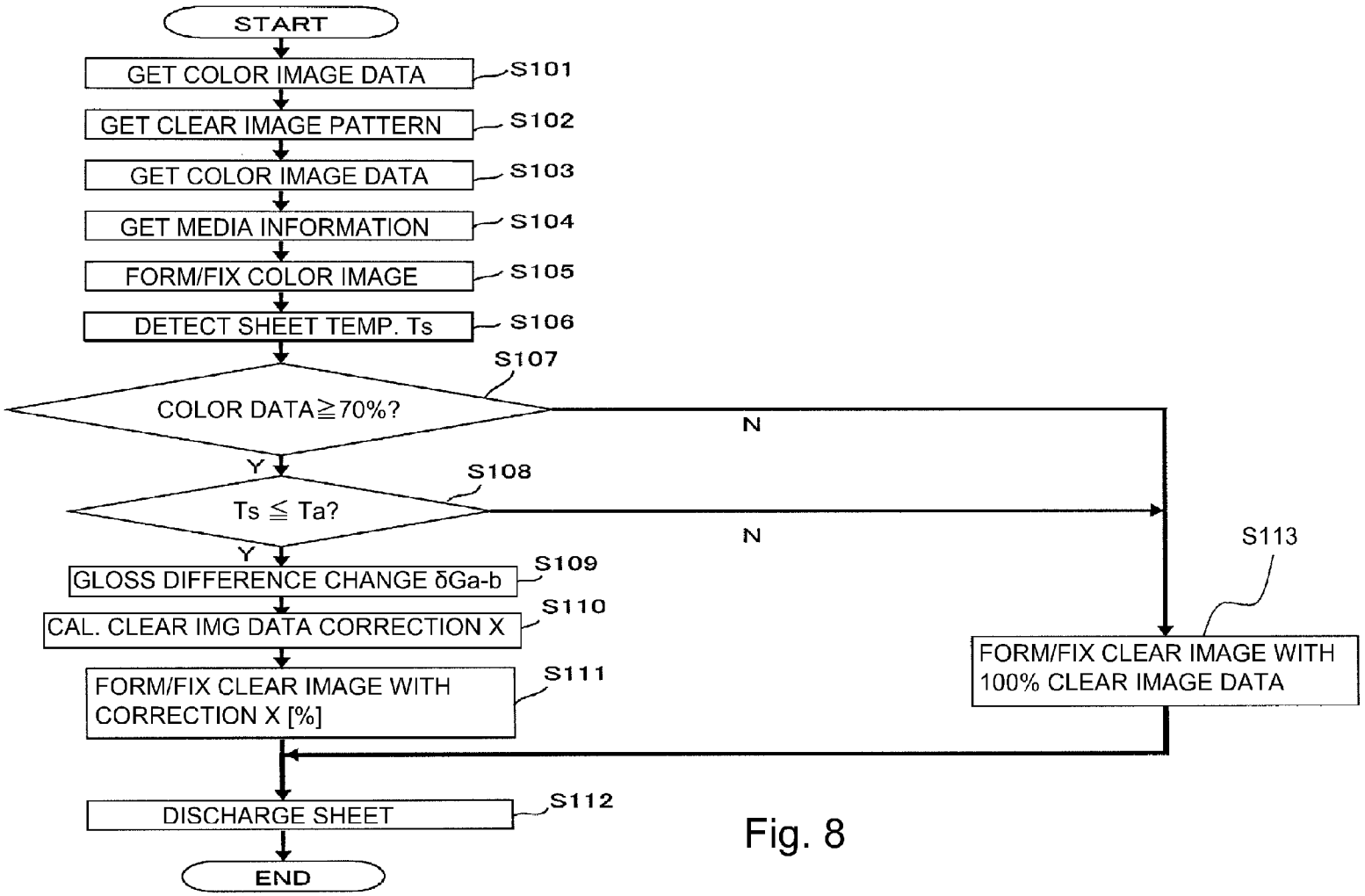
FIG. 8 is a flow chart of a control in the first embodiment.

FIG. 8 is a flow chart of image formation control sequence in this embodiment. In step S101, the color image data information is obtained by the color image data input portion 501. In step S102, the clear image pattern is designated (the clear image data is obtained) by the clear image pattern designation portion 505. In step S103, the color image data is obtained by the total toner amount calculation portion 508. In step S104, the media information is designated by the media information designating portion 507. For example, a gloss coated paper sheet having a basis weight of the 150 g/m$^2$ is designated. In step S105, on the basis of the color image data information obtained in step S101, four color image printing is carried out on the recording material P in the non-transparent image forming station 2.

More particularly, first, in the first color yellow image forming station Y, the surface of the photosensitive drum 21 is charged uniformly to the predetermined polarity and potential by the charging roller 22 supplied with the charging bias voltage. The charged surface of the photosensitive drum 21 is exposed to a laser beam in accordance with the image signal from the exposing unit 23, so that an electrostatic latent image (electrostatic image) is formed. The latent image on the photosensitive drum (image bearing member) 21 is developed by the developing device 24 with the yellow toner (developer) carried on the surface of the developing roller supplied with a developing bias voltage. Thus, a heat fusible yellow toner image (first color non-transparent image) is formed on the surface of the photosensitive drum 21. Similar image forming processes are carried out in the magenta, cyan and black image forming stations M, C and K. By this, toner images (developed images) of respective colors are formed on the surfaces of the photosensitive drums 21 in the image forming stations M, C and K.

In the respective image forming stations Y, M, C and K, the toner images formed on the surfaces of the photosensitive drums 21 are superimposedly transferred onto the surface of the intermediary transfer belt 26, by the primary transfer bias applied to the primary transfer roller 28 from the transfer bias voltage source (not shown). By this, a color toner image is formed on the surface of the intermediary transfer belt 26.

On the other hand, the pick-up roller 12 of the feeding portion 1 picks up the recording material P from the feeding cassette 100 to the pair of the feeding rollers 13, which feeds the recording material P to the registration rollers 14.

In the non-transparent image forming station 2, the secondary transfer bias voltage is applied to the secondary transfer roller 29 from the transfer bias voltage source (not shown). By this, the color toner image on the surface of the intermediary transfer belt 26 is transferred (secondary transfer) altogether onto the recording material P fed into the secondary transfer nip T2 by the registration rollers 14 of the first feeding portion 1, and the recording material P carries the color toner image. The recording material P departing the secondary transfer nip T2 is introduced into the fixing nip N1 of the first fixing portion 3.

Then, the first fixing portion 3 heats and fixes the unfixed color toner image on the recording material P. The fixing roller 31 and the pressing roller 32 nip and feed the recording material P carrying the unfixed color toner image by the fixing nip therebetween. During the feeding process, the color toner image is subjected to the heat and a nip pressure from the surface of the fixing roller 31 and the surface of the pressing roller 32. By this, the color toner image is fused and is fixed on the recording material P.

In step S106, the recording material temperature detecting portion 506 obtains temperature data information of the recording material. In step S107, the determination is made as to whether or not the color image data obtained in step S103 is 70% or higher. If so (≥70%), the operation goes to step S108, and if not, the operation goes to step S113. In step S108, the determination is made as to whether or not the temperature Ts of the recording material obtained in step S106 is a reference value Ta or lower. If so (Ts≤Ta), the operation goes to step S109, and if not (Ts>Ta), it goes to step S113. Here, the reference value Ta is preset depending on the kind of image forming apparatus. In this embodiment, the reference value Ta is variable in the range of 20-50° C. or 30-40° C., for example, in accordance with the detection result of an ambient condition sensor, provided in the image forming apparatus, for detecting an ambient temperature in the image forming apparatus. The temperature range may be changed depending on the kind of the recording material (media).

In step S109, a table, stored beforehand in the control device 200*y* (or 200*x*), of the relation between the temperature variation of the recording material vs. glossiness variation δG for each media, is referred to regarding the media information obtained in the step S104. A predicted variation amount δGa of the glossiness Ga of the color portion, and a predicted variation amount δGb of the glossiness Gb of the clear portion are calculated, and then the variation δGa−b of the glossiness difference is calculated. For example, from FIG. 4, in the case that the detected temperature is 10° C., and the temperature of the recording material after the temperature in the image forming apparatus sufficiently rises is 40° C., the predicted variation amount δGa is 2, and the predicted variation amount δGb is 10, and therefore, the glossiness difference variation δGa−b is 8. Here, the temperature of the recording material when the temperature in the image forming apparatus sufficiently rises is different depending on ambient condition, and therefore, it is changed in accordance with the detection result of the ambient condition sensor together with the reference value Ta. More particularly, in this embodiment, the table of the predicted glossiness variation amount relative to the color portion and clear portion temperature changes is prepared, for each ambient condition.

The glossiness variation due to the recording material temperature variation of the color portion is small, and therefore, the table for δGa may be omitted wherein only the table for the prediction variation amount δGb of the clear portion glossiness Gb is used. In such a case, the predicted variation amount δGb of the glossiness Gb of the clear portion is calculated as the glossiness variation difference.

In step S110, a table, stored beforehand in the control device 200*y* (or 200*x*) of the relation between the clear image data and the glossiness for each media, about the media information obtained in the step S103, and the clear image data correction value X is calculated from the glossiness difference variation δGa−b. For example, from FIG. 6, when the glossiness difference variation δGa−b is 8, the correction is made such that the clear image data is lowered from 100% to 50%.

In such a toner amount correction control, the difference between the transparent toner amount based on the clear image data in the clear portion and the clear toner amount in the clear portion (the former amount is further smaller then the latter) increases with decrease of the temperature detected by the temperature sensor 9. As will be understood from FIG. 6 (clear image data vs. glossiness), the glossiness increases with decrease of the clear data. On the other hand, as will be understood from FIG. 5 (temperature variation of the recording material vs. glossiness variation δG), the glossiness difference increases with decrease of the temperature of the recording material. Therefore, in order to reduce the variation of the glossiness difference, the control is such that the glossiness increases with decrease of the temperature of the recording material. From the foregoing analysis, the clear image data is corrected such that the difference between the transparent toner amount based on the clear image data in the clear portion and the clear toner amount in the clear portion increases with decrease of the temperature detected by the temperature sensor 9.

In step S111, using the clear image pattern obtained in step S102 and the clear image data correction value X obtained in step S109, the clear toner is overlaid on the color toner image on the recording material P in the transparent image forming station 5. More particularly, the surface of the photosensitive drum 51 is charged uniformly to a predetermined polarity and potential by the charging roller 52 supplied with the charging bias voltage. The charged surface of the photosensitive drum 51 is exposed to laser beam in accordance with the image signal from the exposing unit 53, so that an electrostatic latent image (electrostatic image) is formed. The latent image is developed by the developing device 54 with transparent toner (developer) carried on the developing roller supplied with a developing bias voltage so that a heat fusible transparent toner image (transparent image) is formed on the surface of the photosensitive drum 51. The transparent toner image formed on the surface of the photosensitive drum 21 is transferred onto the surface of the intermediary transfer belt 56 by the primary transfer bias applied from the transfer bias voltage source (not shown) to the primary transfer roller 58. By doing so, a transparent toner image is formed on the surface of the intermediary transfer belt 56.

On the other hand, the registration rollers 72 of the third feeding portion 7 feed, to the secondary transfer nip T4 of the transparent image forming station 5, the recording material P deflected to the feeding path 71 by the reversing deflector 16. In the transparent image forming station 5, the secondary transfer bias voltage is applied from the transfer bias voltage source (not shown) to the secondary transfer roller 59. By this, the transparent toner image on the surface of the intermediary transfer belt 56 is secondary transferred onto the recording material P fed into the secondary transfer nip T4 by the registration roller 72. Thus, the recording material P carries the transparent toner image on the color toner image. The recording material P departing the secondary transfer nip T4 is introduced into the fixing nip of the second fixing portion 6.

The second fixing portion 6 heats and fixes the unfixed transparent toner image on the recording material P. The fixing roller 31 and the pressing roller 32 nip and feed the recording material P carrying the unfixed transparent toner image by the fixing nip. In the feeding process, the toner image is subjected to the heat and the nip pressure from the surface of the fixing roller 31 and the surface of the pressing roller 32. By this, the toner image is fused and fixed on the recording material P.

In step S112, the recording material P now carrying the transparent toner image on the color toner image, discharged onto the discharging tray 76 of the image forming apparatus through the feeding path 71 of the third feeding portion 7. In step S113, the clear toner is overlaid on the color toner image on the recording material P in the transparent image forming station 5 with clear image data of 100%.

Figure 9:
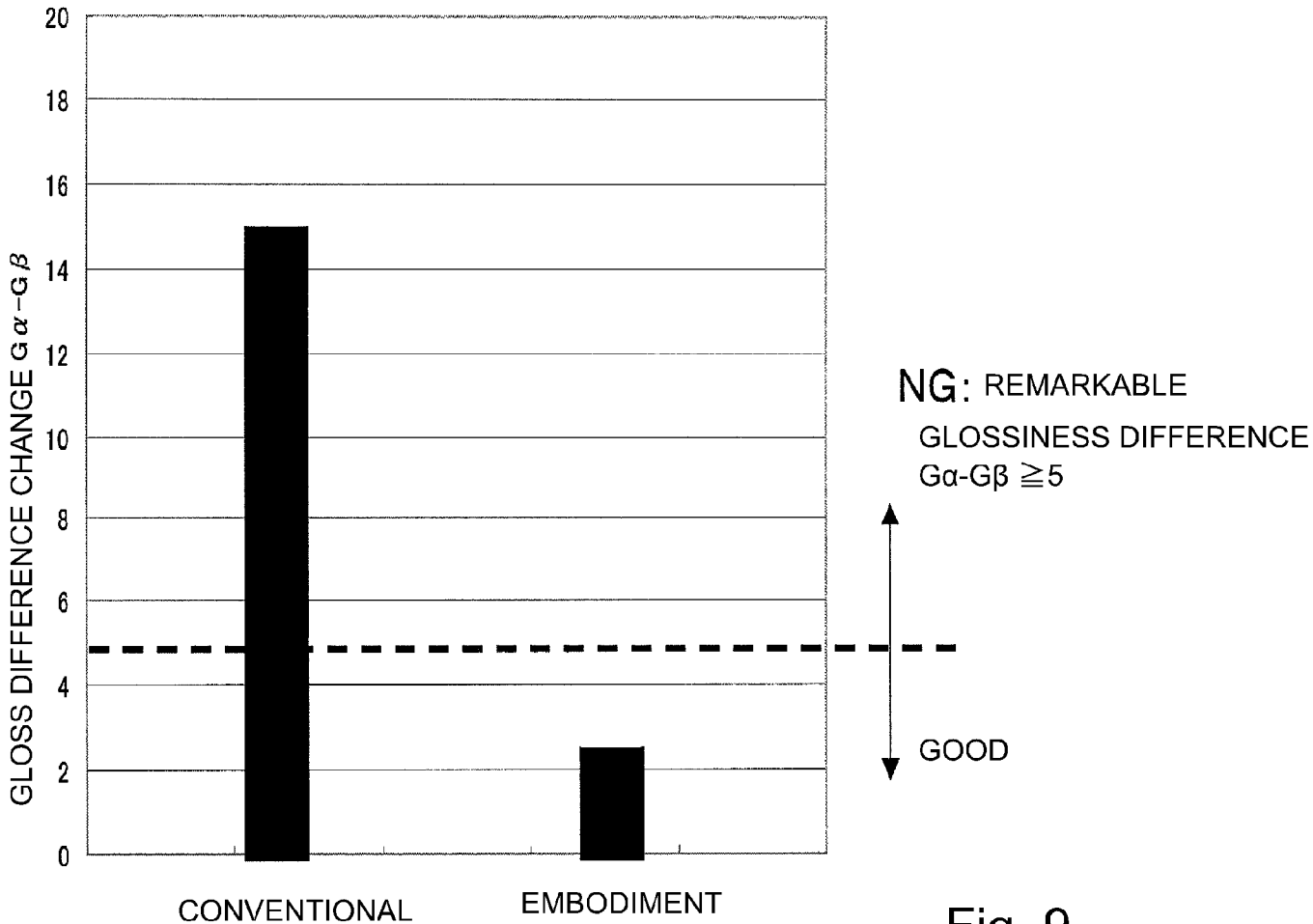
FIG. 9 illustrates an effect of the first embodiment.

FIG. 9 is a result of comparison between this embodiment and a conventional example when 100 prints are produced on gloss coated paper sheets having a basis weight of 150 g/m$^2$, wherein the clear toner is partly overlaid on the color image data 100%. In the conventional example, the control of this embodiment is not carried out, and in this embodiment, the control is carried out. More particularly, the same 100 prints were produced, and the glossinesses of the color portion and the clear portion were measured at predetermined positions, and the glossiness differences are determined. Among the prints, the glossiness difference Gα print and the minimum glossiness difference Gβ are determined, and a glossiness difference variation δGα−Gβ was obtained. From FIG. 9, it is understood the conventional example in which the clear image data is not corrected in accordance with the temperature of the recording material, the glossiness difference variation δGα−Gβ is as large as 15.3, which means remarkable difference of the glossiness feeling. However, using the structure of the embodiment, the glossiness difference variation δGα−Gβ decreases to 2.2, and therefore, the difference of the glossiness feeling is not remarkable. As described hereinbefore, if the glossiness difference variation is not more than 5, the difference is not easily recognized, and therefore, according to this embodiment the glossiness difference variation can be suppressed to a level not more than 5.

From the foregoing, in-line partial clear mode, when the color image data is larger, the clear image data are corrected in accordance with temperature of the recording material to suppress the glossiness variation of the clear portion, thus accomplishing a desired clear-effect.

<Second Embodiment>

In the first embodiment, when there is a region in which the color image data is not less than 70%, the clear image is overlaid on the region, and the amount of the clear image data is corrected by the same amount depending on the temperature of the recording material. However, there is a possibility of such an image pattern that the clear image is overlaid on both of a region C where the color image data is small the amount of the color toner is small) and a region D where the color image data is large (the amount of the color toner is large). For such regions, if the clear image data is controlled evenly in accordance with the temperature of the recording material as in first embodiment, the glossiness variation of the clear portion can be suppressed in the region D, but in the region C, it is likely that the glossiness of the clear portion is too high.

More particularly, if the color image data of the region C is less than 70% (50%, for example), the glossiness difference variation is small as will be understood from FIG. 5. On the other hand, if the color image data of the region D is not less than 70% (100%, for example), the glossiness difference variation is large. If the clear image data of the region C and region D which have different glossiness difference variation are evenly corrected, the glossiness feeling is different between the regions.

Therefore, in this embodiment, the desired glossiness can be provided in the clear portion, irrespective of the image pattern. The data amount of the clear portion of the region C is not corrected, and for the region D, the data amount of the clear portion is corrected into a clear image data pattern, under which the image formation is effected.

Figure 10:
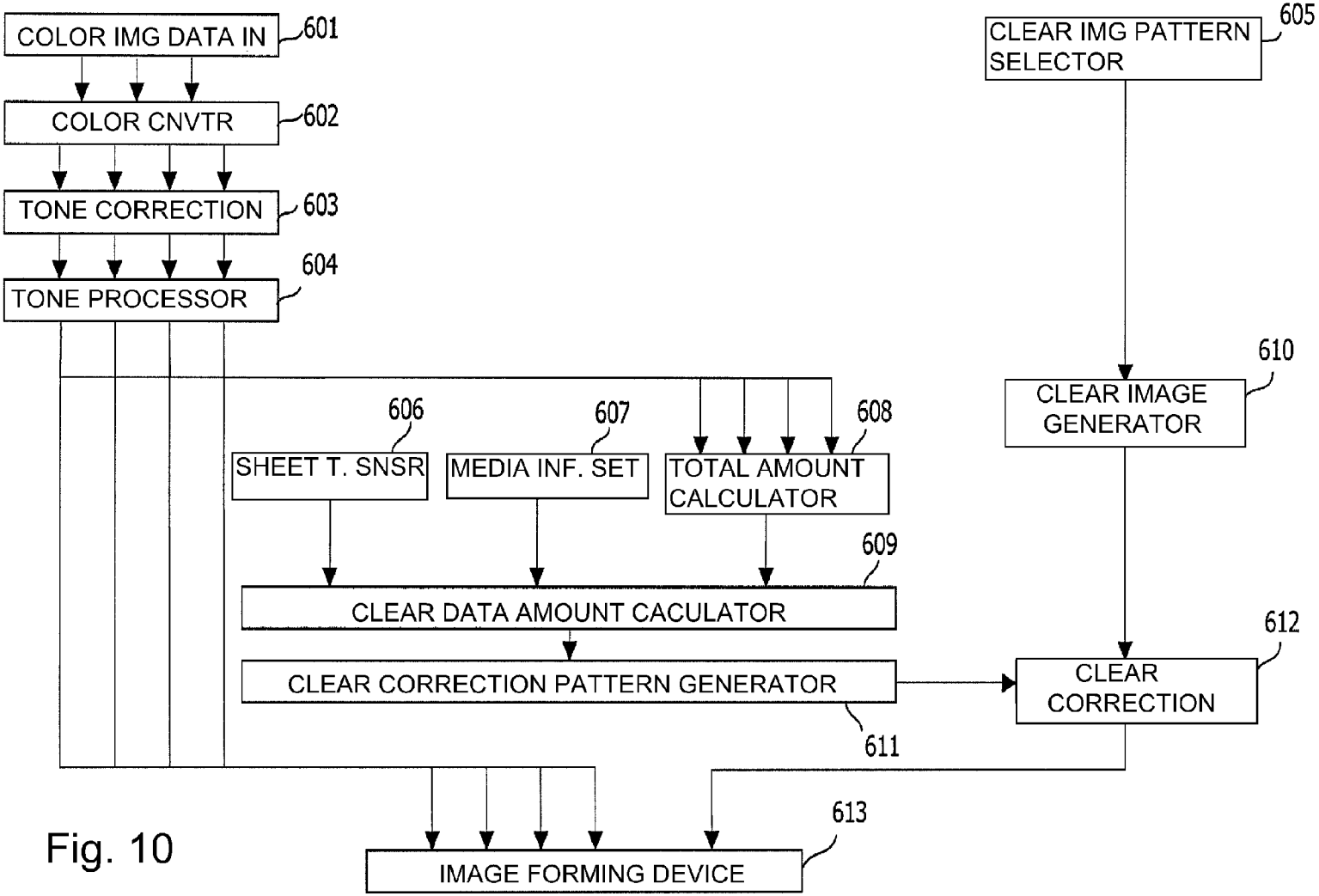
FIG. 10 is a block diagram of an image processing controller used in a second embodiment of the present invention.
Figure 12:
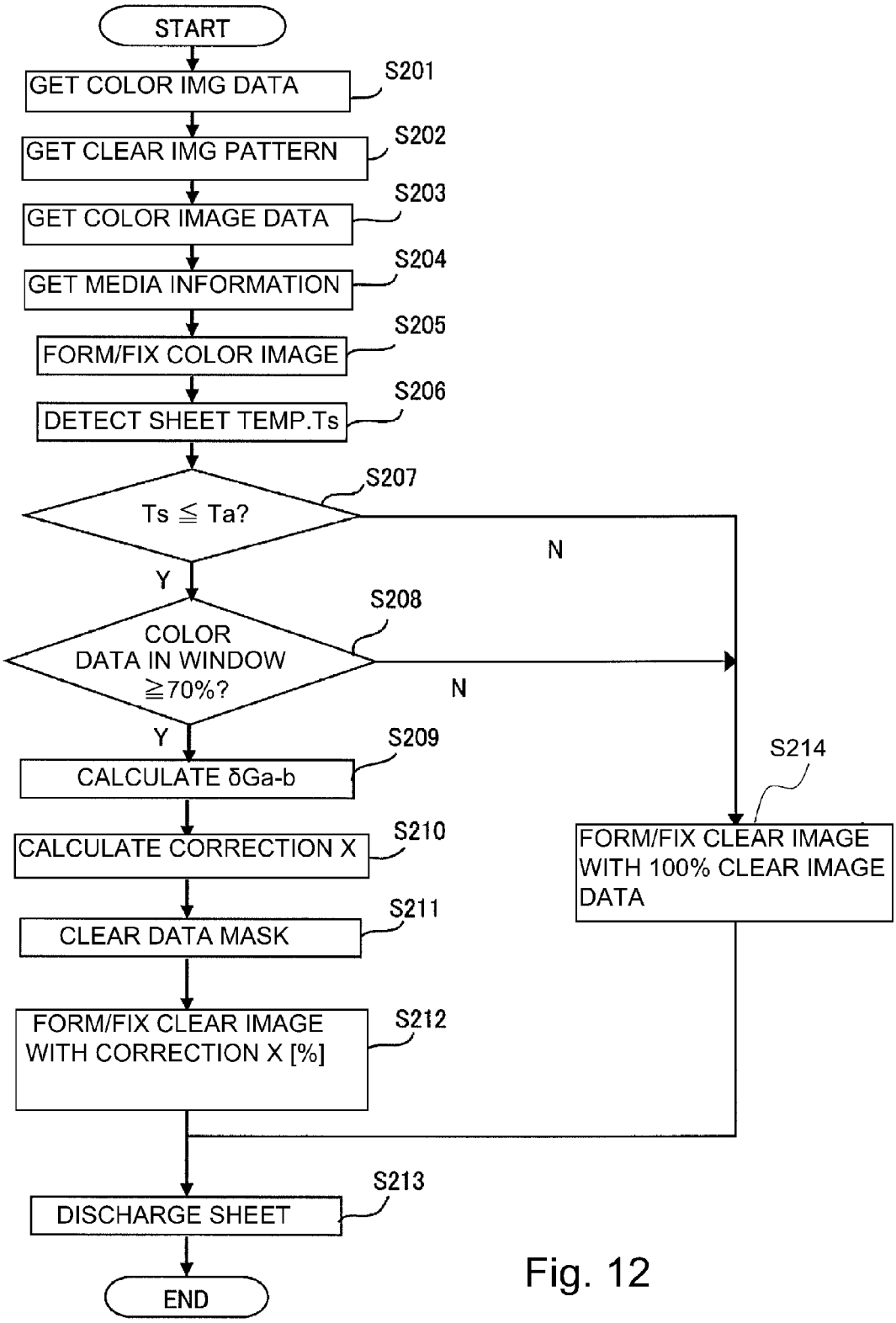
FIG. 12 is a flow chart of a control in the second embodiment.

Referring to FIGS. 10-12, this embodiment will be described. In the description of this embodiment, the same reference numerals as in Embodiment 1 are assigned to the elements having the corresponding functions in this embodiment, and the detailed description thereof is omitted for simplicity.

FIG. 10 is a block diagram of an image processing controller for executing the image formation in this embodiment. As regards a color image data input portion 601, a color converting portion 602, a tone gradation correcting portion 603, a half-tone processing portion 604, a clear image pattern designation portion 605, a recording material temperature detecting portion 606, and a media information designating portion 607, the same as with Embodiment 1 applies. A total toner amount calculation portion 608 obtains the total toner amount of C, MY and K determines other than the clear toner component. The total toner amount is a sum of C, MY and K signal amount (color image data) for each pixel. The total toner amount information (color image data) for each pixel obtained by the total toner amount calculation portion 608 is sent to the clear data amount calculation portion 609.

The clear data amount calculation portion 609 calculates the clear data amount for each pixel, on the basis of the temperature of the recording material detected by the recording material temperature detecting portion 606, the media information designated by the media information designating portion 607, and the color image data calculated by the total toner amount calculation portion 608. The information of the clear data amount calculated by the clear data amount calculation portion 609 is sent to the clear correction pattern generation portion 611.

The clear correction pattern generation portion 611 generates a correction pattern for correcting the clear image data in accordance with data amount value determined by the clear data amount calculation portion 609. The image signal generated by the clear image generation portion 610 is inputted to the correction processing portion 612. The correction processing portion 612 effects the correction process using the correction pattern generated by the clear correction pattern generation portion 611. The details of the correction processing portion 612 will be described hereinafter.

In this embodiment, the clear image data is corrected when the condition which will be described hereinafter is met. The correction of the clear image data amount controls printing area percentage of the clear toner layer. The clear image data correction value provided by the correction processing portion 612 is sent to the image forming station 613 together with the C, M, Y and K image signals provided by the half-tone processing portion 604. The full-color image of C, MY and K and the clear toner image are combined, and are printed on the recording material to provide a final output image.

The clear toner amount control system using the above-described total toner amount calculation portion 608, clear data amount calculation portion 609, the clear correction pattern generation portion 611, correction processing portion 612 will be described. The total toner amount calculation portion 608 which is the obtaining means obtains a value relating to a toner amount for each predetermined region provided by dividing the non-transparent toner image (full-color image). For example, the color image data (value relating to the toner amount) for each region of a predetermined amount pixel are obtained. Then, the toner amount correction control described in the first embodiment is executed, for the transparent toner amount to be overlaid to the region where the value relating to the toner amount obtained by the total toner amount calculation portion 608 is equal to or more than a predetermined value (color image data of 70%, for example). On the other hand, no correction is made for the transparent toner amount to be overlaid to the region where the value relating to the toner amount obtained by the total toner amount calculation portion 608 is less than the predetermined value.

This will be described more in detail. FIG. 11 shows a distribution of total toner signals (color image data) for respective pixels in a window of 5×5 pixels. The window is a predetermined region comprising a plurality of pixels. The total toner amount calculation portion 608 generates a total toner signal from 8 bit integers (0-255) for each C, MY and K image signal value for each corresponding pixel. FIG. 11 shows a result of the total toner signal (color image data) obtained for each pixel of the 5×5 pixels in percentage.

The color image data for each pixel in the window outputted from the total toner amount calculation portion 608 are sent to the clear data amount calculation portion 609. The clear data amount calculation portion 609 obtains an average of the values in FIG. 11 within the window to obtain an average of the color image data. In the example of FIG. 11, it is 204.6%. The clear data amount calculation portion 609 sends the calculated average of the color image data to the clear correction pattern generation portion 611. Simultaneously, the clear data amount calculation portion 609 calculates a clear image data correction value X%, on the basis of a recording material temperature and a media kind provided by the recording material temperature detecting portion 606 and the media information designating portion 607.

The clear correction pattern generation portion 611 designates the clear image data amount for each window, on the basis of a clear image data correction value provided by the clear data amount calculation portion 609 and the color image data. In this embodiment, for the window where the average of the color image data is not less than 70%, the correction of the clear image data amount is carried out using the clear image data correction value X%. For the window where the total toner amount is less than 70%, the correction of the clear image data amount is not carried out, and therefore, 100% level is maintained.

The clear image data generated by the clear image generation portion 610 is multiplied by the correction pattern outputted from the clear correction pattern generation portion 611, for each window by the clear correction processing portion 612, and then are finally sent to the image forming station 613. In the clear correction pattern generation portion 611, the above-described window process is effected for 5×5 window.

FIG. 12 is a flow chart of an example of the image formation control sequence according to this embodiment. Steps S201, S202 are similar to S101, S102 of FIG. 8. In step S203, the color image data for each pixel is obtained by the total toner amount calculation portion 608. Steps S204, S205, S206 are similar to S104-S106 of FIG. 8. A step S207 is similar to S108 of FIG. 8. In step S208, the determination is made as to whether or not the color image data (average) in the window (predetermined region) is equal to or larger than 70%, and if so, the operation goes to step S208, and if not, it goes to step S214. Steps S209, S210 are similar to S109, S110 of FIG. 8. In step S211, the correction process (clear data masking process) is carried out using the clear correction pattern corresponding to the clear image data correction value X calculated in step S210 and the designated clear image pattern. Steps S212, S213, S214 are similar to S111-S113 of FIG. 8.

In this embodiment, the clear image data amount is corrected for each window in accordance with the temperature of the recording material. By doing so, also for the image pattern where the clear image is overlaid both on the region C where the region C is small and the region D where the color image data is large, the glossinesses in the region C and region D can be made proper.

<Other Embodiments>

In the first and second embodiments, the toner amount correction control is such that the clear image data correction value X decreases with a decrease of the detected temperature by the temperature sensor 9. And, in order to accomplish this, the table of a relation shown in FIGS. 4 and 6 is prepared. In a modified example, the toner amount correction control may be simplified such that the detected temperature of the temperature sensor 9 is classified into three levels, for example, and the clear image data correction value is determined for each level. For example, when the detected temperature is higher than 20 and not higher than 30 the clear image data correction value is 70%; when the temperature is higher than 10 and not higher than 20 it is 60%; and when the temperature is not higher than 10 it is another percentage of the clear image data correction value. And, when the detected temperature is higher than 30 no correction is made.

The toner amount correction control of the present invention is not limited to such a control. In another modified example, when the color image data is not less than a predetermined value (70%, for example), and the detected temperature of the temperature sensor 9 is not more than a predetermined detected temperature (20 for example), the clear image data correction value is every a predetermined amount (50%, for example), and no correction is made otherwise. In such an example, the predetermined temperature and/or the predetermined amount may be changed depending on the ambient condition and/or the kind of the media.

While the invention has been described with reference to the structures disclosed herein, it is not confined to the details set forth herein and this application is intended to cover such modifications or changes as may come within the purpose of the improvements or the scope of the following claims.

This application claims priority from Japanese Patent Application No. 191251/2010 filed Aug. 27, 2010, which is hereby incorporated by reference.

What is claimed is:

1. An image forming apparatus comprising:

detecting means for detecting a temperature of a recording material on which a non-transparent toner image is heat-fixed;

transparent image forming means for effecting image formation by transparent toner on the basis of transparent image data;

a heating device for heating the transparent toner image formed by said transparent image forming means; and correcting means for correcting an amount, per unit area, of the transparent toner which is deposited on the non-transparent toner image fixed on the recording material, by said transparent image forming means in accordance with the temperature detected by said detecting means.

2. An apparatus according to claim 1, further comprising obtaining means for obtaining information relating to an amount of the non-transparent toner image, wherein said correcting means corrects the amount of the transparent toner deposited on the recording material by said transparent image forming means on the basis of the information obtained by said obtaining means.

3. An apparatus according to claim 1, wherein said correcting means corrects the amount of the transparent toner such that the amount of the transparent toner when the temperature detected by said detecting means is a first temperature is larger than that when the temperature detected by said detecting means is a second temperature which is higher than the first temperature.

4. An apparatus according to claim 1, wherein said correcting means corrects the amount of the transparent toner when the temperature detected by said temperature detecting means is not more than a predetermined temperature.

5. An apparatus according to claim 2, wherein said correcting means corrects the amount of the transparent toner when a value obtained by said obtaining means is not less than a predetermined value.

6. An apparatus according to claim 2, wherein said obtaining means obtains a value relating to a toner amount of each of predetermined regions into which the non-transparent toner image is divided, and said correcting means corrects the amount of the transparent toner for such regions where the values are not less than a predetermined value.

7. An apparatus according to claim 1, further comprising non-transparent image forming means for effecting image formation on the recording material with the non-transparent toner on the basis of non-transparent image data.

* * * * *